US010352203B2

(12) United States Patent
Ozawa

(10) Patent No.: US 10,352,203 B2
(45) Date of Patent: Jul. 16, 2019

(54) HYDRAULIC LASH ADJUSTER AND METHOD FOR USING HYDRAULIC LASH ADJUSTER

(71) Applicant: NITTAN VALVE CO., LTD., Kanagawa (JP)

(72) Inventor: Hiroyuki Ozawa, Kanagawa (JP)

(73) Assignee: NITTAN VALVE CO., LTD., Kanagawa (JP)

( * ) Notice: Subject to any disclaimer, the term of this patent is extended or adjusted under 35 U.S.C. 154(b) by 144 days.

(21) Appl. No.: 15/501,390

(22) PCT Filed: Sep. 17, 2014

(86) PCT No.: PCT/JP2014/074523
§ 371 (c)(1),
(2) Date: Feb. 2, 2017

(87) PCT Pub. No.: WO2016/042615
PCT Pub. Date: Mar. 24, 2016

(65) Prior Publication Data

US 2017/0218796 A1 Aug. 3, 2017

(51) Int. Cl.
*F01L 1/24* (2006.01)
*F01L 1/245* (2006.01)
(Continued)

(52) U.S. Cl.
CPC ..... *F01L 1/245* (2013.01); *F01L 1/20* (2013.01); *F01L 1/255* (2013.01); *F01L 1/2405* (2013.01); *F01L 2103/00* (2013.01)

(58) Field of Classification Search
CPC ... F01L 1/14; F01L 1/24; F01L 1/2405; F01L 1/2422; F01L 1/46
(Continued)

(56) References Cited

U.S. PATENT DOCUMENTS 5,901,676 A * 5/1999 Edelmayer ..... F01L 1/2405 123/90.35
5,979,377 A 11/1999 Barth et al.
2010/0065012 A1* 3/2010 Fujii ..... F01L 1/2405 123/195 R

FOREIGN PATENT DOCUMENTS

JP 59-119006 A 7/1984
JP 59119006 A * 7/1984 ..... F01L 1/245
(Continued)

OTHER PUBLICATIONS

Written Opinion of the International Searching Authority dated Dec. 9, 2014 in the corresponding application PCT/JP2014/074523.

*Primary Examiner* — Jorge L Leon, Jr.
(74) *Attorney, Agent, or Firm* — Roberts Mlotkowski Safran Cole & Calderon P.C.

(57) ABSTRACT

Air is restrained from flowing into a high pressure chamber while the number of parts is reduced. A plunger is slidably fitted into a body; a reservoir is formed in the plunger with a communication hole formed in a head section thereof to allow communication between an inside and an outside; a high pressure chamber is formed in the body between the body and the plunger bottom section; an oil supply hole is formed in a plunger circumferential wall section; a return spring is interposed between the body and the plunger; a valve mechanism is disposed on the plunger bottom section; the reservoir is set such that a space continuously extends; and the oil supply hole is oriented outward in the radial direction as compared to an axis of the plunger.

5 Claims, 6 Drawing Sheets

(51) Int. Cl.
*F01L 1/255* (2006.01)
*F01L 1/20* (2006.01)

(58) Field of Classification Search
USPC ..... 123/90.43, 90.46, 90.55
See application file for complete search history.

(56) References Cited

FOREIGN PATENT DOCUMENTS

| | | | | |
|---|---|---|---|---|
| JP | 5-44411 | A | | 2/1993 |
| JP | 05044411 | A | * | 2/1993 |
| JP | 0002887964 | B | | 5/1999 |
| JP | 2008-25394 | A | | 2/2008 |
| JP | 2008025394 | A | * | 2/2008 |
| JP | 2009047127 | A | | 3/2009 |
| JP | 2013-189926 | A | | 9/2013 |
| JP | 2014-9644 | A | | 1/2014 |
| KR | 19990030492 | U | | 7/1999 |

* cited by examiner

PRIOR ART

HYDRAULIC LASH ADJUSTER AND METHOD FOR USING HYDRAULIC LASH ADJUSTER

CROSS-REFERENCE TO RELATED APPLICATIONS

The present application is a U.S. National Phase of PCT/JP2014/074523 filed on Sep. 17, 2014. The disclosure of the PCT Application is hereby incorporated by reference into the present Application.

TECHNICAL FIELD

The present invention relates to a hydraulic lash adjuster and a method of using a hydraulic lash adjuster.

BACKGROUND ART

An internal-combustion engine of an automobile etc. includes a camshaft rotationally driven in synchronization with rotation of an engine, a cam fixed to the camshaft, and a rocker arm disposed between the cam and a valve stem of an intake valve (or exhaust valve) swingably with a hydraulic lash adjuster used as a fulcrum. In this engine, a drive force from the camshaft is transmitted through the cam and the rocker arm to the valve stem so that the valve stem is displaced, and this displacement of the valve stem causes the intake valve (or the exhaust valve) to open/close. In this operation, the hydraulic lash adjuster automatically adjusts a valve clearance between the cam and the rocker arm in accordance with the drive (stretching and contracting operations) thereof.

In general, as described in Patent Document 1, such a hydraulic lash adjuster has a hollow plunger slidably fitted into a bottomed cylindrical body with a head section thereof projected from an opening side of the body; the plunger has a low pressure chamber formed to store an oil by using an inside thereof and a communication hole formed in the head section thereof to allow communication between an inside and an outside of the low pressure chamber; the body has a high pressure chamber formed therein and filled with an oil between a bottom section of the body and a bottom section of the plunger; respective circumferential wall sections of the body and the plunger are each provided with an oil supply hole for making up an oil supply passage supplying the oil into the low pressure chamber; a biasing means is interposed between the bottom section of the body and the bottom section of the plunger; and a valve mechanism is disposed on the bottom section of the plunger and opens to allow the oil to flow from the low pressure chamber into the high pressure chamber when the plunger performs a stretching motion based on a restoring force of the biasing means.

By using this hydraulic lash adjuster for a valve moving mechanism in an internal-combustion engine, the rocker arm can swingably be supported at the head section of the plunger and, when the plunger receives an input load from the rocker arm with an oil pressure in the high pressure chamber and performs a contracting motion, a damping force can be generated. On the other hand, when a valve clearance is generated, the plunger performs a stretching motion in a direction (a stretching direction) of eliminating the valve clearance.

When the engine is operated, the hydraulic lash adjuster as described above is supplied with an oil pumped out from an oil pan by an oil pump through an oil passage and the low pressure chamber to the high pressure chamber. Therefore, the oil may have air entrained on the way as air bubbles and, if the air is accumulated in the high pressure chamber, the air is compressed in a contracting motion of the plunger and facilitates the contracting motion of the plunger, impairing a basic function of applying a damping force to the plunger.

In view of such situations, a hydraulic lash adjuster is recently proposed so as to prevent air bubbles made of air in the oil from flowing into the high pressure chamber as described in Patent Document 2 and the hydraulic lash adjuster has a cylindrical guide tube additionally disposed in the plunger such that the oil flowing from the oil supply passage into the plunger is guided to the head section of the plunger by using an annular space between an outer circumferential surface of the guide tube and an inner circumferential surface of the plunger. Specifically, a tube with a tip-side outer diameter shorter than a base-side outer diameter is prepared as the guide tube, and a base-side outer circumferential surface thereof is fitted to and retained by a plunger inner circumferential surface on the bottom section side of the plunger relative to the oil supply passage with the tip side of the guide tube directed toward the head section side of the plunger, so as to form the annular space between the inner circumferential surface of the plunger and the outer circumferential surface of the guide tube on the head section side of the plunger relative to the oil supply passage. As a result, when the engine is operated, the oil supplied from the oil supply passage is first guided through the annular space toward the head section side of the plunger, and the air is gradually separated from the oil in the head section of the plunger (coarsening of air bubbles). While the oil itself flows through the inside of the guide tube toward the high pressure chamber as the valve mechanism opens, the separated air is discharged from the communication hole in the plunger head section along with a surplus oil to the outside. Consequently, even if an oil with air entrained as air bubbles is supplied into the plunger, the air in the oil can be restrained from flowing into the high pressure chamber.

PRIOR ART DOCUMENTS

Patent Documents

Patent Document 1: Japanese Laid-Open Patent Publication No. 2013-189926

Patent Document 2: Japanese Patent No. 4159605

SUMMARY OF THE INVENTION

Problem to be Solved by the Invention

However, the hydraulic lash adjuster must have the guide tube additionally disposed in the plunger to restrain the air from flowing into the high pressure chamber and the annular space formed as an oil guide passage between the outer circumferential surface of the guide tube and the inner circumferential surface of the plunger, which results in an increase in the number of parts of the lash adjuster.

The present invention was conceived in view of the situations and it is therefore a first object of the present invention to provide a hydraulic lash adjuster capable of restraining air from flowing into the high pressure chamber while reducing the number of parts.

A second object is to provide a method of using the hydraulic lash adjuster.

Means for Solving Problem

To achieve the first object, the present invention provides a hydraulic lash adjuster having a hollow plunger slidably fitted into a bottomed cylindrical body with a head section thereof projected from an opening side of the body, the plunger having a low pressure chamber formed to store an oil by using an inside thereof and a communication hole formed in the head section thereof to allow communication between an inside and an outside of the low pressure chamber, the body having a high pressure chamber formed therein and filled with an oil between a bottom section of the body and a bottom section of the plunger, the plunger having an oil supply hole formed in a circumferential wall section for making up an oil supply passage supplying the oil into the low pressure chamber, the hydraulic lash adjuster having a biasing means interposed between the bottom section of the body and the bottom section of the plunger, the hydraulic lash adjuster having a valve mechanism disposed on the bottom section of the plunger, the valve mechanism opening to allow the oil to flow from the low pressure chamber into the high pressure chamber when the plunger performs a stretching motion based on a restoring force of the biasing means, wherein the low pressure chamber is set such that a space continuously extends entirely through the plunger in an axial direction and entirely from an axis to an inner circumferential surface of the plunger in a radial direction, and wherein the oil supply hole in the plunger is oriented outward in the radial direction of the plunger as compared to the axis of the plunger.

To achieve the second object, the present invention provides a method of using a hydraulic lash adjuster having a hollow plunger slidably fitted into a bottomed cylindrical body with a head section thereof projected from an opening side of the body, the plunger having a low pressure chamber formed to store an oil by using an inside thereof and a communication hole formed in the head section thereof to allow communication between an inside and an outside of the low pressure chamber, the body having a high pressure chamber formed therein and filled with an oil between a bottom section of the body and a bottom section of the plunger, the plunger having an oil supply hole formed in a circumferential wall section for making up an oil supply passage supplying the oil into the low pressure chamber, the hydraulic lash adjuster having a biasing means interposed between the bottom section of the body and the bottom section of the plunger, the hydraulic lash adjuster having a valve mechanism disposed on the bottom section of the plunger, the valve mechanism opening to allow the oil to flow from the low pressure chamber into the high pressure chamber when the plunger performs a stretching motion based on a restoring force of the biasing means, the low pressure chamber being set such that a space continuously extends entirely through the plunger in an axial direction and entirely from an axis to an inner circumferential surface of the plunger in a radial direction, the oil supply hole in the plunger being oriented outward in the radial direction of the plunger as compared to the axis of the plunger, wherein the hydraulic lash adjuster is used for generating a swirl flow of oil in the low pressure chamber by supplying the oil from the oil supply hole in the plunger to the low pressure chamber.

Effect of the Invention

According to the present invention, since the low pressure chamber is set such that a space continuously extends entirely through the plunger in an axial direction and entirely from an axis to an inner circumferential surface of the plunger in a radial direction and the oil supply hole in the plunger is oriented outward in the radial direction of the plunger as compared to the axis of the plunger, a swirl flow (swirl) of oil is generated in the low pressure chamber in association with supply of oil from the oil supply hole into the plunger and, even when air bubbles are contained in the oil, the air bubbles are moved through the swirl flow toward a radial central region of the swirl flow relative to the oil (gas-liquid separation utilizing a centrifugal separation effect). As a result, since the air bubbles collide (integrate) with each other and the volume expansion of the air bubbles is promoted based on a pressure reduced as the air bubbles move toward the radial central region of the oil swirl flow (the coarsening of air bubbles is facilitated), the coarsened air bubbles concentrate in the radial central region of the oil swirl flow, and the air bubbles are further integrated and coarsened. Therefore, the air bubbles (coarsened air bubbles) in the oil have a large buoyant force in the radial central region of the oil swirl flow and the air bubbles are actively guided into the head section of the plunger based on the large buoyant force. When such air bubbles are guided into the head section of the plunger, the buoyant force of the air bubbles further increase (air bubbles are further coarsened) based on a reduction in oil pressure (static pressure) around the air bubbles, and the air bubbles are restrained from moving from the head section toward the bottom section of the plunger while the air bubbles in the plunger head section are sequentially discharged along with a surplus oil from the communication hole to the outside. Consequently, the hydraulic lash adjuster can restrain air from flowing into the high pressure chamber even without specially disposing a guide tube in the plunger and therefor can easily restrain the air from flowing into the high pressure chamber while reducing the number of parts.

Since the oil supply hole in the plunger is disposed at a position made closer to the bottom section of the plunger than to a head section of the plunger, even when air bubbles in the oil in the low pressure chamber are present at a position close to the high pressure chamber, the air bubbles can immediately be coarsened based on a centrifugal separation effect due to the oil swirl flow, and the coarsened air bubbles can rapidly be raised toward the plunger head section of the plunger based on the buoyant force thereof. Therefore, even when air bubbles are present at position close to the high pressure chamber in the low pressure chamber, the air bubbles can immediately be moved toward the plunger head section to restrain the air bubbles from flowing into the high pressure chamber.

Moreover, the axial length of the plunger and the internal space (the low pressure chamber) inside the plunger can effectively be utilized to extend the distance from the oil supply hole in the plunger to the plunger head section as long as possible, and the integration of the air bubbles with each other in the oil and the increase in volume of the air bubbles can be facilitated through the long distance to further enhance the coarsening (increase the buoyant force)

of the air bubbles in the oil on the plunger head section side. Therefore, once the air bubbles reach the plunger head section side, the air bubbles can be made difficult to move toward the high pressure chamber.

Since a plurality of oil supply holes in the plunger is disposed such that the plurality of oil supply holes is disposed at different positions in a circumferential direction of the plunger and the plurality of oil supply holes is oriented to the same inclination side outward in the radial direction of the plunger as compared to the axis of the plunger, oil flows supplied from the oil supply holes generate respective swirl flows flowing in the same direction along an inner circumferential surface of the plunger in the low pressure chamber, and the oil swirl flow can certainly be generated in the low pressure chamber. Therefore, the action and effect described above can properly be produced.

Since the oil supply hole in the plunger is oriented obliquely toward the head section of the plunger as the oil supply hole extends inward in a thickness direction of the circumferential wall section of the plunger, the oil supplied from the oil supply hole into the plunger is supplied toward the plunger head section far away from the high pressure chamber rather than toward the high pressure chamber, the swirl flow in the low pressure chamber turns into a helical flow swirling and flowing toward the plunger head section. As a result, since the air bubbles can be made present mainly on the plunger head section side relative to the oil supply hole in the low pressure chamber and the coarsening of the air bubbles is facilitated on the plunger head section side based on the centrifugal separation effect described above, the air bubbles can effectively be restrained from being present on the plunger bottom section side. Therefore, the air is further restrained from flowing into the high pressure chamber.

Since the hydraulic lash adjuster has the low pressure chamber set such that a space continuously extends entirely through the plunger in an axial direction and entirely from an axis to an inner circumferential surface of the plunger in a radial direction, and has the oil supply hole in the plunger oriented outward in the radial direction of the plunger as compared to the axis of the plunger, and the hydraulic lash adjuster is used for generating a swirl flow of oil in the low pressure chamber by supplying the oil from the oil supply hole in the plunger to the low pressure chamber, the hydraulic lash adjuster is utilized and used in the method. Therefore, a method of using the hydraulic lash adjuster can be provided.

Since the oil supply hole in the plunger is disposed at a position made closer to the bottom section of the plunger than to a head section of the plunger and the hydraulic lash adjuster is used for generating a swirl flow of oil at the position made closer to the bottom section of the plunger than to the head section of the plunger, the hydraulic lash adjuster is utilized and used in the method. Therefore, a method of using the hydraulic lash adjuster can be provided.

Since a plurality of oil supply holes in the plunger is disposed such that the plurality of oil supply holes is disposed at different positions in a circumferential direction of the plunger while the plurality of oil supply holes has an orientation direction inclined to the same side outward in the radial direction of the plunger relative to the axis of the plunger and the hydraulic lash adjuster is used for flowing oil flows supplied from the oil supply holes in the same direction along an inner circumferential surface of the plunger, the hydraulic lash adjuster is utilized and used in the method. Therefore, a method of using the hydraulic lash adjuster can be provided.

Since the oil supply hole in the plunger is oriented obliquely toward the head section of the plunger as the oil supply hole extends inward in a thickness direction of the circumferential wall section of the plunger, and the hydraulic lash adjuster is used for turning a swirl flow of oil in the low pressure chamber into a helical flow toward the head section of the plunger, the hydraulic lash adjuster utilized and used in the method. Therefore, a method of using the hydraulic lash can be provided.

MODES FOR CARRYING OUT THE INVENTION

Embodiments of the present invention will now be described with reference to the drawings.

Figure 1:
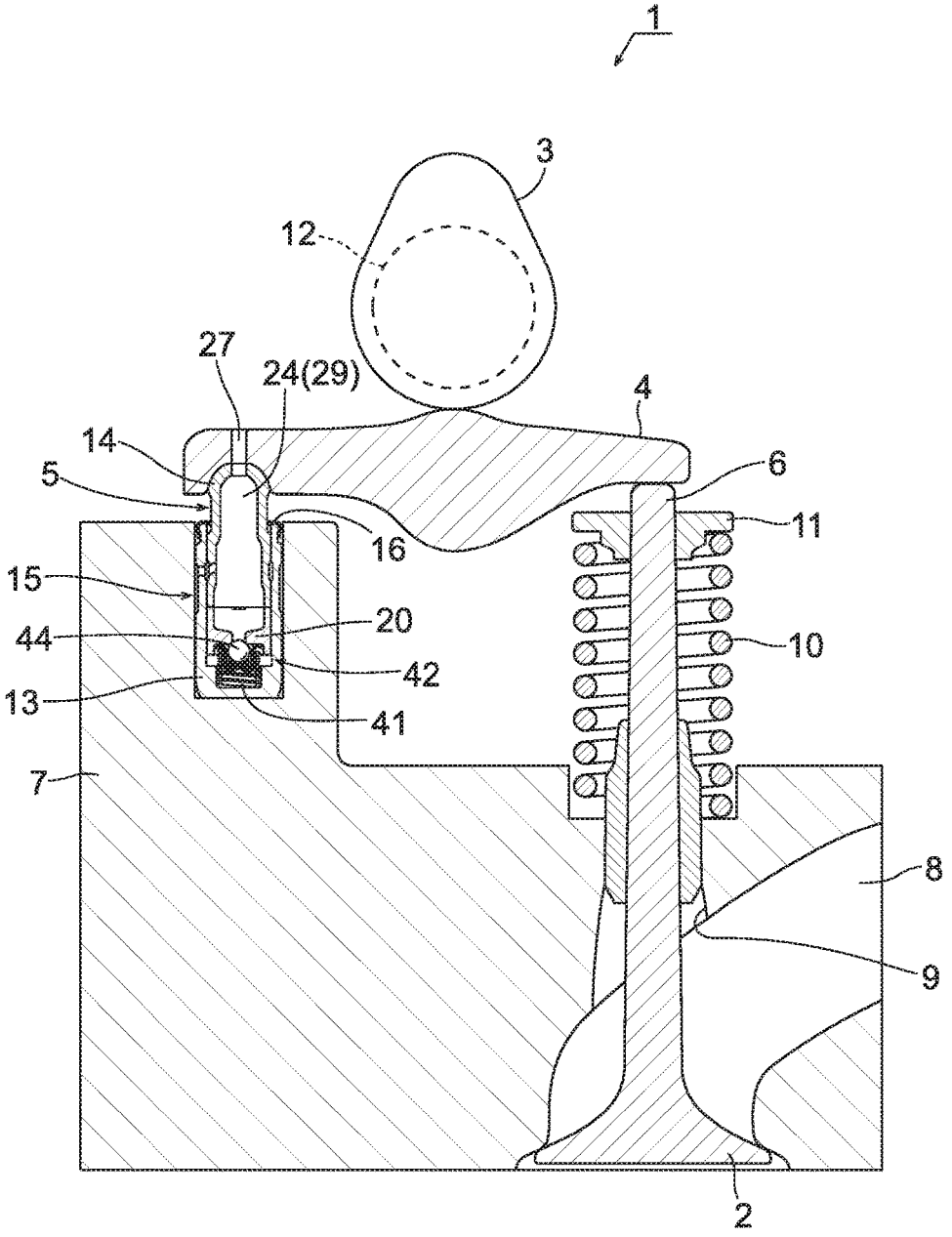
FIG. 1 is a longitudinal sectional view of a valve moving mechanism incorporating a hydraulic lash adjuster according to a first embodiment.

In FIG. 1, reference numeral 1 denotes a valve moving mechanism of an internal-combustion engine. This valve moving mechanism 1 is a mechanism opening and closing an intake port or an exhaust port leading to a combustion chamber and includes an intake valve or an exhaust valve (hereinafter referred to as the valve) 2 opening and closing the intake port or the exhaust port, a rotationally driven cam 3, a rocker arm 4 disposed between the valve 2 and the cam 3 and transmitting a rotary drive force of the cam 3 to the valve as an acting force, and a hydraulic lash adjuster 5 acting as a fulcrum to support the rocker arm 4.

The valve 2 integrally includes a valve stem 6 as in a known manner and the valve stem 6 is freely slidably inserted in a through-hole 9 leading to an intake port (or an exhaust port) 8 formed in a cylinder head 7 of an engine. A compression coil spring 10 is wound around an outer circumference of the valve stem 6 in a loosely fitted state, and the compression coil spring 10 is mounted between the cylinder head 7 and a retainer 11 fixed to an upper section of the valve stem 6 and biases the valve 2 in a direction of closing the opening of the intake port (or the exhaust port) 8.

The cam 3 is fixed to a camshaft 12 rotationally driven in synchronization with rotation of an automobile engine, and the cam 3 is rotationally driven in accordance with the rotation of the camshaft 12.

The rocker arm 4 transmits the rotary drive force of the cam 3 through swinging based on the rotary drive of the cam 3 to the valve stem 6, and the valve stem 6 slides in the through-hole 9 in accordance with the swinging of the rocker arm 4. As a result, the valve 2 opens and closes the intake port (or the exhaust port) 8 in accordance with the sliding of the valve stem 6.

Figure 2:
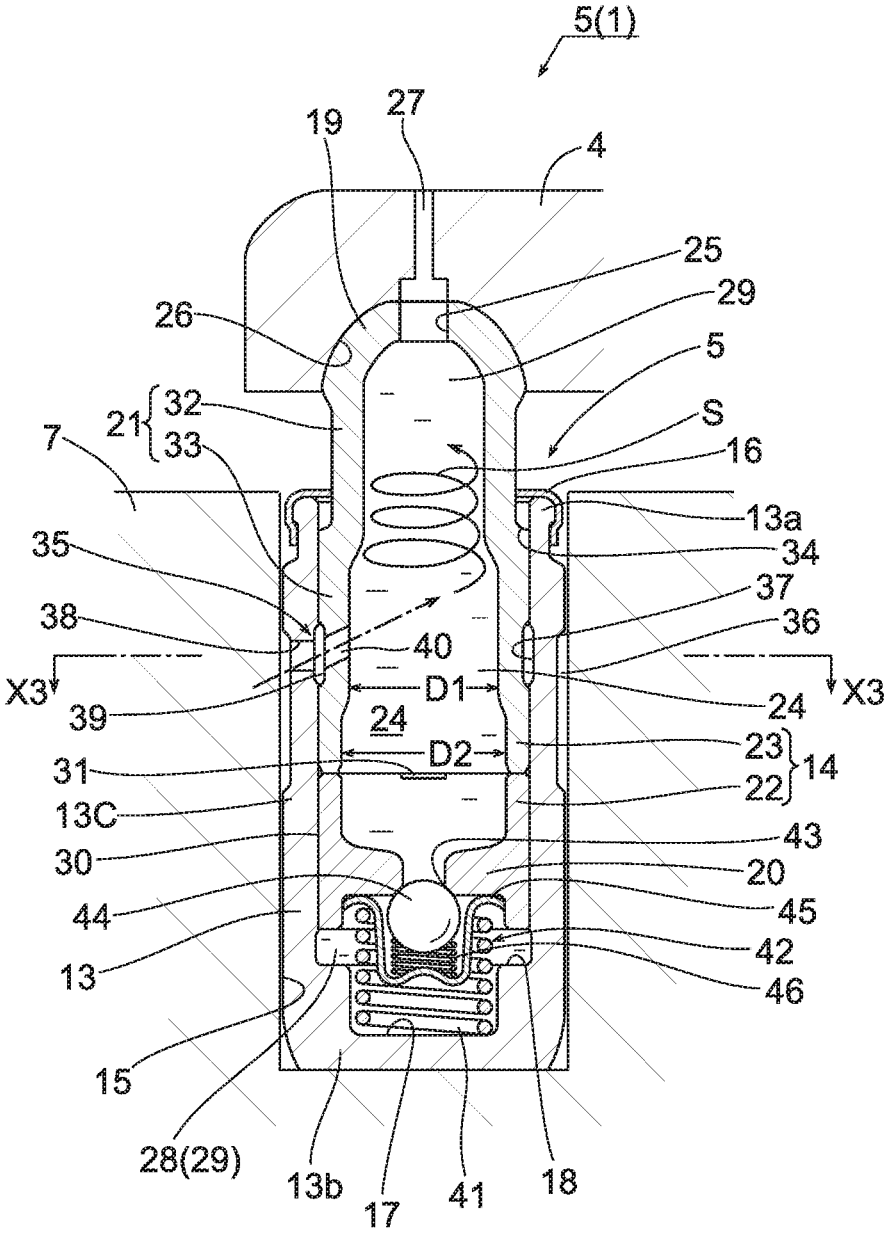
FIG. 2 is a longitudinal sectional view for explaining the hydraulic lash adjuster according to the first embodiment.

The hydraulic lash adjuster 5 has a structure in which a plunger 14 is slidably fitted into a bottomed cylindrical body 13 as shown in FIGS. 1 and 2 so as to support the rocker arm 4 as the fulcrum.

The body 13 is formed into a bottomed cylindrical shape and is housed, with an opening side thereof facing upward, in a cylindrical concave section 15 formed on the upper section side of the cylinder head 7. A small diameter section 13*a* having an outer diameter smaller than the other positions is formed on the upper section outer circumference side of the body 13, and an annular retainer cap 16 is mounted on the small diameter section 13*a* so as to act as a retainer of the plunger 14. A bottom section 13*b* of the body 13 has a recess 17 formed on an inner surface side thereof, and an annular step section 18 is formed between an inner circumferential surface of the recess 17 and an inner circumferential surface of a circumferential wall section 13*c* of the body 13 (the inner circumferential surface on the opening side relative to the bottom section 13*b*).

A hollow rod-like member is used for the plunger 14. The plunger 14 is made up of a head section 19 forming an axial end section, a bottom section 20 forming the other axial end section, and a circumferential wall section 21 extending between the head section 19 and the bottom section 20, and the plunger 14 is protruded on the head section 19 side from the opening of the body 13 with the bottom section 20 side slidably fitted into the body 13.

In this embodiment, as shown in FIG. 2, the plunger 14 is configured as a two-division structure including a bottom-side plunger constituent section 22 and a head-side plunger constituent section 23.

The bottom-side plunger constituent section 22 is formed into a bottomed cylindrical shape to make up a bottom-side portion of the plunger 14, and a bottom section of the bottom-side plunger constituent section 22 serves as the bottom section 20 of the plunger 14 in the body 13 and faces the bottom section 13*b* of the body 13 while an opening of the bottom-side plunger constituent section 22 is directed to the opening side of the body 13.

The head-side plunger constituent section 23 is formed into a bottomed cylindrical shape as a section making up a portion of the plunger 14 on the head section side relative to the bottom-side plunger constituent section 22. The head-side plunger constituent section 23 has a bottom section (the bottom section of the bottomed cylindrical shape) serving as the head section 19 of the plunger 14 and directed to the outside (upper side) of the opening of the body 13 while an opening-side end surface of the head-side plunger constituent section 23 is placed on an opening-side end surface of the bottom-side plunger constituent section 22 in the body 13. As a result, the internal space of the head-side plunger constituent section 23 and the internal space of the bottom-side plunger constituent section 22 cooperate with each other to form a reservoir 24 as a low pressure chamber for storing an oil.

As shown in FIG. 2, the head section 19 of the plunger 14 (the head-side plunger constituent section 23) is formed to bulge into an approximately hemispherical shape, and the head section 19 is provided with a communication hole 25 allowing communication between the inside and the outside of the plunger 14. In accordance with the approximately hemispherical head section 19 of the plunger 14, the rocker arm 4 has an approximately hemispherical concave section 26 formed on a surface contacting with the plunger 14 and has a communication passage 27 allowing communication between the inside and the outside of the concave section 26, and the head section 19 of the plunger 14 acts as a fulcrum of the rocker arm 4 to receive the concave section 26 of the rocker arm 4.

As shown in FIG. 2, the bottom section 20 of the plunger 14 defines a high pressure chamber 28 in the body 13. The high pressure chamber 28 is filled with an oil 29 so that when an input load from the rocker arm 4 is input to the plunger head section 19, the input load is received by the oil 29 in the high pressure chamber 28 and, in this case, the oil 29 in the high pressure chamber 28 leaks into a minute gap 30 between an outer circumferential surface of the circumferential wall section 21 of the plunger 14 (the bottom-side plunger constituent section 22) and an inner circumferential surface of the circumferential wall section 13*c* of the body 13 and is returned from a separation plane between the head-side plunger constituent section 23 and the bottom-side plunger constituent section 22 into the reservoir 24 (into the plunger 14). In this embodiment, to facilitate the oil leaking into the gap 30 to return into the plunger 14 in this case, an oil return port 31 is formed between the head-side plunger constituent section 23 and the bottom-side plunger constituent section 22 (in the separation plane), and the oil return port 31 allows communication between the gap 30 and the inside of the reservoir 24.

As shown in FIG. 2, the circumferential wall section of the plunger 14 has a head-side circumferential wall section 32 (made up of a portion of the head-side plunger constituent section 23) continuous with the head section 19 of the plunger 14, and a main circumferential wall section 33 (made up of a portion of the head-side plunger constituent section 23 and the bottom-side plunger constituent section 22) on the bottom section side of the plunger 14 relative to the head-side circumferential wall section 32. The outer diameter of the head-side circumferential wall section 32 is reduced as compared to the outer diameter of the main circumferential wall section 33, so that a step section 34 is formed between an outer circumferential surface of the head-side circumferential wall section 32 and an outer circumferential surface of the main circumferential wall section 33, and the step section 34 faces the retainer cap 16 in the body 13 so as to fulfill a retaining function of the plunger 14. The inner diameter of the head-side circumferential wall section 32 is also reduced in accordance with the outer diameter thereof as compared to the inner diameter of the main circumferential wall section 33, and an inner diameter of the reservoir 24 is smaller on the head-side circumferential wall section 32 side (the head section 19 side of the plunger 14) as compared to the main circumferential wall section 33 side (the bottom section side of the plunger 14).

The inner diameter of the main circumferential wall section 33 in this embodiment has a first inner diameter D1 that is an inner diameter of a portion close to the head-side circumferential wall section 32 and a second inner diameter D2 that is an inner diameter of a portion far from the head-side circumferential wall section 32, and the first inner diameter D1 is somewhat smaller than the second inner diameter D2.

As shown in FIG. 2, an oil supply passage 35 is formed in the circumferential wall sections of the body 13 and the plunger 14 so as to supply the reservoir 24 with an oil pumped out from an oil pan (not shown) by an oil pump. In this embodiment, the oil supply passage 35 is made up of annular grooves 36, 37 formed respectively on the outer circumferential surface and the inner circumferential surface of the body circumferential wall section 13*c*, an oil supply hole 38 extending between the both annular grooves 36, 37, an annular groove 39 formed on an outer circumferential surface of the circumferential wall section 21 of the plunger 14 at a substantially axial center of the plunger 14, and an oil supply hole 40 extending between the annular groove 39 and the reservoir 24, and a communicating state of the oil supply passage 35 is ensured by utilizing an overlapping relationship between the annular grooves 37, 39 of the body 13 and the plunger 14 even in the case of stretching/contracting motion or relative rotation of the plunger 14 with respect to the body 13. Therefore, when the oil pumped out from the oil pan (not shown) by the oil pump is supplied through an oil passage (not shown) in the cylinder head 7 to the annular groove 36 on the outer circumferential surface of the body circumferential wall section 13*c* during operation of the engine, the oil supplied to the annular groove 36 is supplied through the oil supply hole 38 inside the body circumferential wall section 13*c* to the annular groove 37 on the inner circumferential surface of the body circumferential wall section 13*c*. The oil supplied to the annular groove 37 is further supplied to the annular groove 39 on the outer circumferential surface of the circumferential wall section 21 of the plunger 14, and the oil supplied to the annular groove 39 is supplied through the oil supply hole 40 inside the circumferential wall section 21 of the plunger 14 to the reservoir 24. As a result, the inside of the reservoir 24 is filled with the oil 29 during operation of the engine, and a surplus oil generated due to supply of the oil to the reservoir 24 is discharged from the communication hole 25 of the plunger head section 19 to the outside. In this case, the discharged oil serves as a lubrication oil to provide lubricity to the rocker arm 4 etc.

Figure 3:
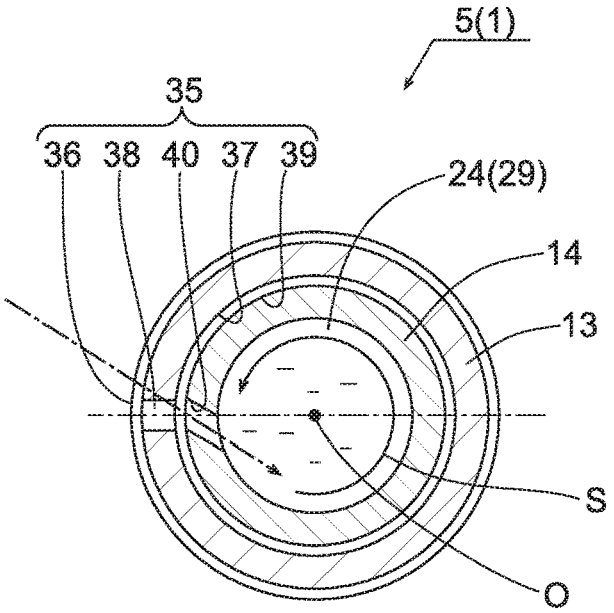
FIG. 3 is an enlarged cross-sectional view taken along a line X3-X3 of FIG. 2.

Among the constituent elements of the oil supply passage 35, as shown in FIG. 3, the oil supply hole 40 in the plunger 14 is oriented outward in the radial direction of the plunger 14 as compared to an axis O of the plunger 14 (see dashed-dotted lines of FIG. 3) and, when the oil is supplied from the oil supply hole 40 into the reservoir 24, a swirl flow S (see a solid arrow of FIG. 3) of the oil is generated in the reservoir 24.

Additionally, in this embodiment, as shown in FIG. 2, the oil supply hole 40 is oriented obliquely toward the head section 19 of the plunger 14 (see a dashed-dotted line of FIG. 2) as the oil supply hole 40 extends inward in a thickness direction (left-right direction of FIG. 2) of the circumferential wall section of the plunger 14. As a result, when the oil is supplied from the oil supply hole 40 in the plunger 14 into the reservoir 24, the oil is jetted out toward the head section 19 of the plunger 14 (to the upper side of FIG. 2) as compared to the thickness direction of the circumferential wall section of the plunger 14, and the swirl flow S is combined with the jet of the oil toward the plunger head section 19 and is turned into a helical flow swirling and flowing toward the plunger head section 19 as indicated by a solid arrow of FIG. 2.

As shown in FIG. 2, a return spring 41 is interposed as a biasing means between the bottom section 13*b* of the body 13 and the bottom section 20 of the plunger 14 (the bottom section of the recess 17). This return spring 41 is compressed in association with the contracting motion of the plunger 14 relative to the body 13, and the return spring 41 holds a restoring force (resilient force) based on the compression of the return spring 41.

As shown in FIG. 2, the bottom section 20 of the plunger 14 is provided with a valve mechanism 42 on the high pressure chamber 28 side. The valve mechanism 42 includes a valve hole 43 formed in a radial central section of the plunger bottom section 20 to allow an oil to flow from the reservoir 24 into the high pressure chamber 28, a check ball 44 disposed in the high pressure chamber 28 to face the valve hole 43, a retainer 45 pressed against the plunger bottom section 20 by the return spring 41, and a check ball spring 46 interposed between the retainer 45 and the check ball 44 to bias the check ball 44 in a direction of seating on a peripheral edge section of the valve hole 43. Therefore, when the plunger 14 performs the contracting motion relative to the body 13, the valve hole 43 is put into a closed valve state by the check ball 44, and when the plunger 14 performs a stretching motion relative to the body 13, the check ball 44 moves away from the valve hole 43 peripheral edge section (valve seat), and the valve mechanism 42 allows the oil to flow from the reservoir 24 into the high pressure chamber 28.

In the valve moving mechanism 42 as described above, the oil pump supplies the oil in the oil pan through the oil passage (not shown) and the oil supply passage 35 to the reservoir 24 of the plunger 14 (the hydraulic lash adjuster 5) in accordance with the drive of the engine after the start of the engine, and as a result, the inside of the reservoir 24 is filled with the oil 29 while the surplus oil is discharged to the outside from the communication hole 25 of the plunger head section 19 and the communication passage 27 of the rocker arm 4.

In this case, when the cam 3 rotates in accordance with the drive of the engine and the rocker arm 4 swings in the direction of lowering the point of action thereof and displaces the valve stem 6 in the valve opening direction of the valve 2, the rocker arm 4 attempts to turn over due to an elastic force of the compression coil spring 10 and the plunger 14 is pressed by the rocker arm 4 in a descending direction. This makes an oil pressure higher in the high pressure chamber 28 and turns the oil 29 in the high pressure chamber 28 into a rigid body, and the lash adjuster 5 acts as a fulcrum of the rocker arm 4. In this case, the plunger 14 gradually descends while allowing a slight amount of oil to leak into the gap 30 between the plunger 14 and the body 13.

When further rotation of the cam 3 in this state causes the rocker arm 4 to further displace the valve stem 6 in the valve opening direction of the valve 2, the valve 2 opens the intake port (or the exhaust port) 8 to allow communication with an intake passage (or an exhaust passage) through the intake port (or the exhaust port) 8.

On the other hand, after the intake port (or the exhaust port) 8 is opened, when the cam 3 further rotates and the valve stem 6 is displaced in a valve closing direction of the valve 2 due to the elastic force of the compression coil spring 10, the rocker arm 4 swings in the direction of raising the point of action thereof and the intake port (or the exhaust port) 8 is closed by the valve 2.

Further rotation of the cam 3 eliminates a reaction of the elastic force of the compression coil spring 10 and generates a gap between the rocker arm 4 and the cam 3, and the plunger 14 performs a stretching motion to the upper side by the gap due to a biasing force of the return spring 41 in the lash adjuster 5. In this case, since a negative pressure is generated in the high pressure chamber 28 and the check ball 44 is pushed down against a biasing force of the check ball spring 46, the oil in the reservoir 24 flows into the high pressure chamber 28, and the check ball 44 closes the valve hole 43 in a balanced state between the pressure in the reservoir 24 and the pressure in the high pressure chamber 28 (standby state).

As described above, when the cam 3 rotates in accordance with the drive of the engine, since the rocker arm 4 swings by using the lash adjuster 5 (the plunger 14) as the fulcrum and the valve stem 6 descends or ascends in accordance with the swinging of the rocker arm 4, the intake port (or the exhaust port) 8 can be opened and closed by the valve 2.

Because air accumulated in the high pressure chamber 28 is compressed in the contracting motion of the plunger 14 and impairs a function of applying a damping force to the plunger 14, the hydraulic lash adjuster 5 in the valve moving mechanism 1 is configured such that the air contained in the oil supplied to the reservoir 24 is hardly taken into the high pressure chamber 28.

Figure 4:
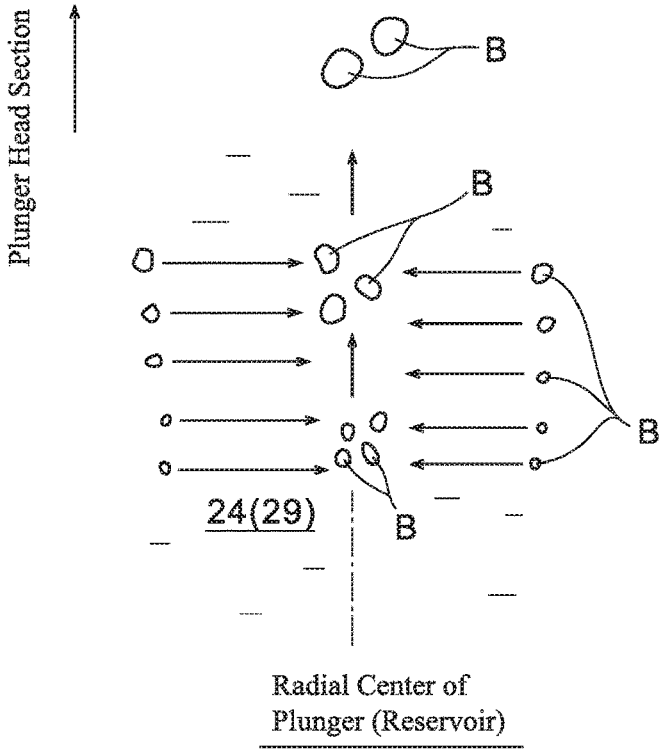
FIG. 4 is an explanatory view for explaining gas-liquid separation due to centrifugal separation in a plunger according to the first embodiment.

In particular, since the oil supply hole 40 in the plunger 14 is oriented outward in the radial direction of the plunger 14 as compared to the axis O of the plunger 14 as shown in FIG. 3 so that the swirl flow S (swirl: see the solid arrow of FIG. 3) of oil in the reservoir 24 in association with the supply of the oil from the oil supply hole 40 into the reservoir 24, even if air is contained as air bubbles in the oil supplied into the reservoir 24, gas-liquid separation occurs between the oil and air bubbles B in the oil based on the oil swirl flow S as shown in FIG. 4 (movement of the air bubbles B is indicated by arrows).

Specifically, under the oil swirl flow S, as shown in FIG. 4, the air bubbles B in the oil relatively move toward a radial central region of the swirl flow S and, since the movement causes the air bubbles B to collide (integrate) with each other and the air bubbles B increase in volume based on a pressure reduced as the air bubbles move toward the radial central region of the oil swirl flow (free vortex) S, coarsened air bubbles concentrate in the radial central region of the oil swirl flow S, and the air bubbles are further coarsened because of collision (integration) and volume expansion due to an ascent. The air bubbles B concentrated in the radial central region of the oil swirl flow S in this way ascend in the oil based on a large buoyant force thereof toward the plunger head section 19 located on the side away from the high pressure chamber 28 even without disposing a guide tube etc., and the ascent rate thereof is accelerated by the volume expansion of the air bubbles associated with the ascent.

When the air bubbles B reach the plunger head section 19, the air bubbles B are restrained from moving from the plunger head section 19 toward the plunger bottom section 20 based on the large buoyant force, and the air bubbles B in the plunger head section 19 are sequentially discharged from the communication hole 25 of the plunger head section 19 to the outside along with a surplus oil generated in association with the oil supply to the reservoir 24.

Figure 5:
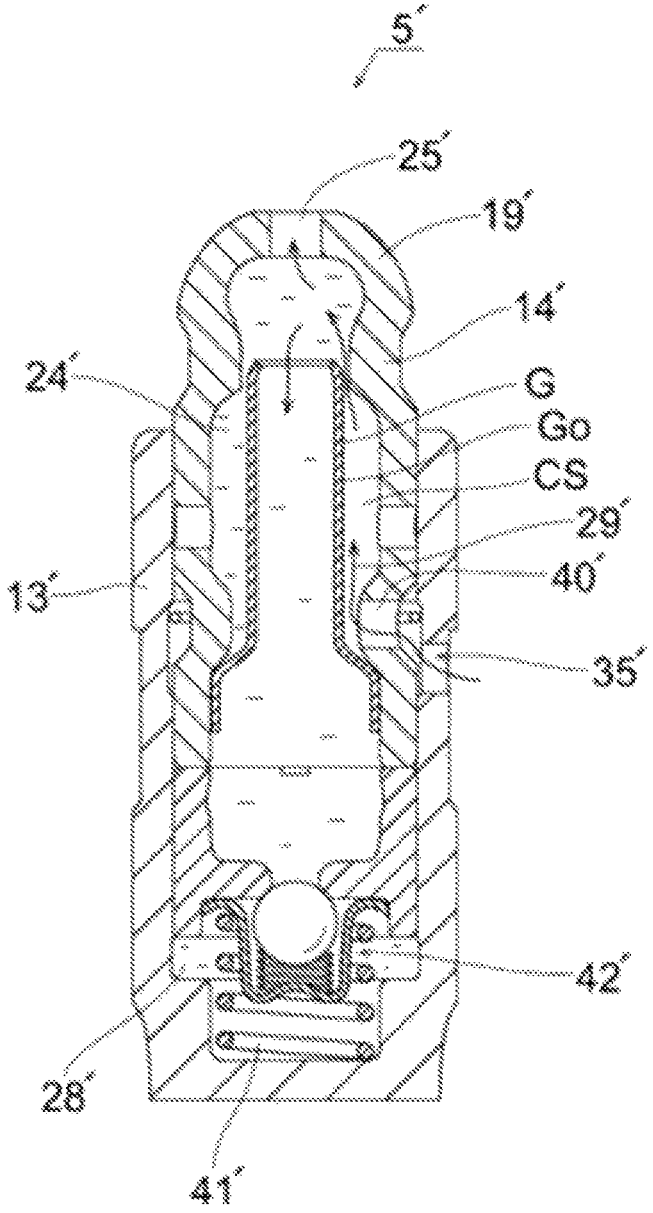
FIG. 5 is a longitudinal sectional view for explaining a structure of a conventional hydraulic lash adjuster and an oil flow when oil is supplied to the inside thereof.

As described above, since the oil supplied to the reservoir 24 can be moved to the plunger head section 19 located on the side away from the high pressure chamber 24 by facilitating the coarsening of the air bubbles B by using the centrifugal separation effect and, when the air bubbles B reach the plunger head section 19, the air bubbles B can be restrained from moving from the plunger head section 19 toward the bottom section 20 based on the large buoyant force of the air bubbles B, it is no longer necessary to dispose a guide tube G in a plunger 14' as in a conventional manner shown in FIG. 5 and to guide an oil 29' toward a head section 19' of the plunger 14' through an annular space CS between an outer circumferential surface Go of the guide tube G and an inner circumferential surface of the plunger 14' while the oil is supplied from an oil supply hole 40' into the plunger 14', so that the need for the guide tube G can be eliminated. It is noted that in a conventional structure shown in FIG. 5, the same constituent elements as those of the structure according to this embodiment are denoted by adding "'" to the same reference numerals.

Particularly in this embodiment, since the oil supply hole 40 of the plunger 14 is oriented obliquely toward the head section 19 of the plunger 14 as the oil supply hole 40 extends inward in a thickness direction of the plunger 14, and the oil supplied from the oil supply passage 35 into the plunger 14 during operation of the engine is jetted out toward the plunger head section 19 far away from the high pressure chamber 28 rather than toward the high pressure chamber 28 (see the arrow from the oil supply hole 40 of FIG. 2), the oil swirl flow S is combined with the jetting of the oil toward the head section 19 of the plunger 14 and is turned into the helical flow (denoted by reference numeral S) swirling and flowing toward the plunger head section 19 (see the solid arrow of FIG. 2). Therefore, since not only the oil supplied into the plunger 14 can be jetted along with air bubbles (air) contained in the oil toward the head section 19 of the plunger 14 far away from the high pressure chamber 28, but also the air bubbles B in the oil supplied from the oil supply hole 40 to the reservoir 24 can be made present based on this fact mainly on the plunger head section 19 side relative to the oil supply hole 40 in the reservoir 24, the coarsening of the air bubbles B can be facilitated on the plunger head section 19 side based on the centrifugal separation effect described above, and the air bubbles B can effectively be restrained from being present on the plunger bottom section 20 side. As a result, the air can further be restrained from flowing into the high pressure chamber 28.

Moreover in this case, since the inner diameter on the head section 19 side of the plunger 14 is reduced as compared to the inner diameter on the bottom section 20 side of the plunger 14 and the oil swirl flow S is increased in speed on the head section 19 side as compared to the bottom section 20 side of the plunger 14, the centrifugal separation effect can be enhanced on the plunger head section 19 side to further increase the effect described above (to increase the discharge of air from the communication hole 25 of the plunger head section 19 and further restrain the air from flowing into the high pressure chamber 28).

Figure 6:
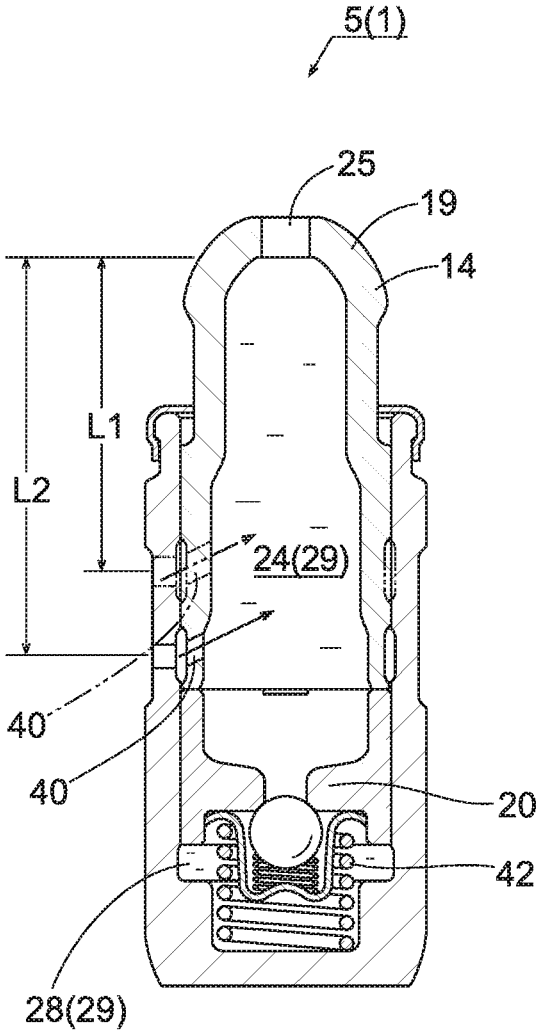
FIG. 6 is a longitudinal sectional view for explaining a hydraulic lash adjuster according to a second embodiment.
Figure 7:
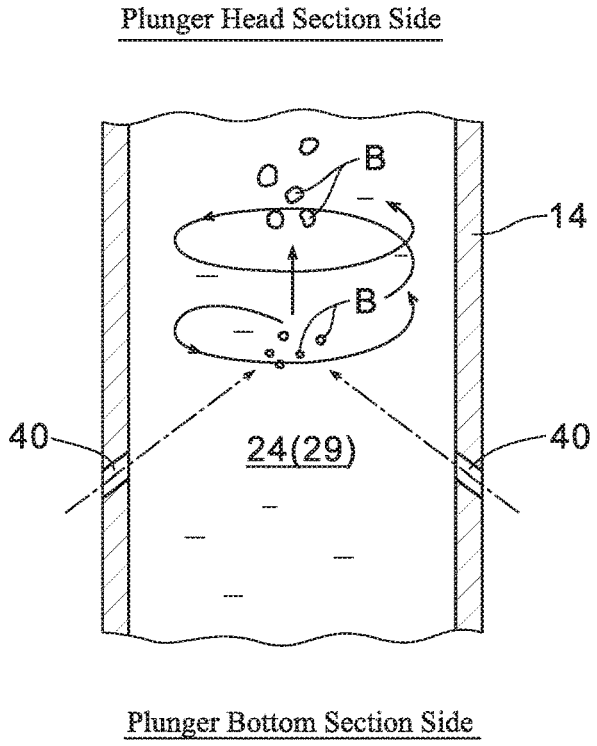
FIG. 7 is a longitudinal sectional view for explaining a hydraulic lash adjuster according to a third embodiment.
Figure 8:
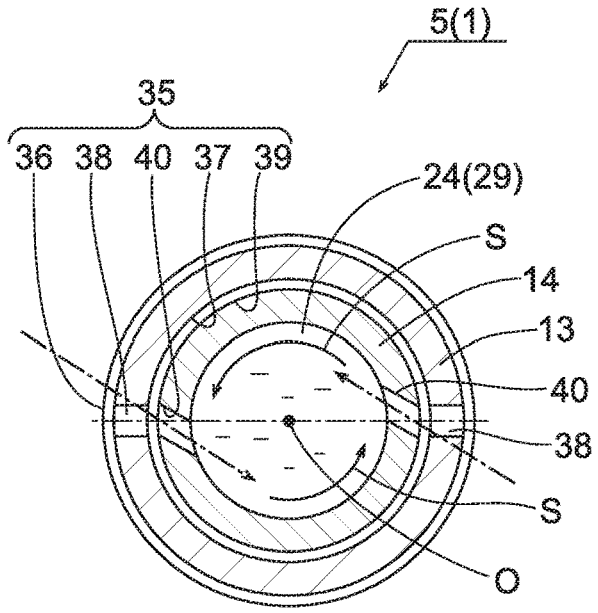
FIG. 8 is a cross-sectional view for explaining an orientation direction of oil supply holes in a plunger according to the third embodiment.

FIG. 6 shows a second embodiment and FIGS. 7 and 8 show a third embodiment. In the embodiments, the same constituent elements as those of the first embodiment are denoted by the same reference numerals and will not be described.

The second embodiment shown in FIG. 6 is a modification example of the first embodiment. In the second embodiment, the position of the oil supply hole 40 disposed in the plunger 14 is made closer to the bottom section 20 of the plunger 14 as compared to the first embodiment so that, while a distance between the communication hole 25 of the plunger head section 19 and the oil supply hole 40 is set to L1 in the case of the first embodiment, the distance is set to L2 longer than L1.

As a result, even when air bubbles in oil in the reservoir 24 are present at a position close to the high pressure chamber 28 (near the position of the oil supply hole 40), the air bubbles B can immediately be coarsened based on the centrifugal separation effect due to the oil swirl flow S, and the coarsened air bubbles B can rapidly be raised toward the plunger head section 19.

Moreover in this case, the axial length of the plunger 14 and the space (the reservoir 24) inside the plunger 14 can effectively be utilized to extend the distance from the oil supply hole 40 in the plunger 14 to the plunger head section 19 as long as possible, and the integration of the air bubbles B with each other in the oil and the increase in volume of the air bubbles can be facilitated through the long distance to further enhance the coarsening of the air bubbles B (increase the buoyant force) in the oil on the plunger head section 19 side. Therefore, once the air bubbles B move toward the plunger head section 19, the air bubbles B on the plunger head section 19 side can be restrained from moving toward the plunger bottom section 20.

Therefore, also in the second embodiment, the air can effectively be restrained from flowing into the high pressure chamber 28.

In the third embodiment shown in FIGS. 7 and 8, a plurality of the oil supply holes 40 in the plunger 14 are disposed, and the plurality of the oil supply holes 40 is disposed at different positions in the circumferential direction of the plunger 14. Additionally, the oil supply holes 40 are oriented to the same inclination side (in FIG. 8, inclined rightward relative to a dashed-dotted line connecting the oil supply holes 40 and the axis O) outward in the radial direction of the plunger 14 as compared to the orientation direction to the axis O of the plunger 14.

As a result, oil flows supplied from the oil supply holes 40 can be flowed in the same direction along the inner circumferential surface of the plunger 14, and the oil swirl flow Scan certainly be generated in the reservoir 24. Therefore, the coarsening of the air bubbles B can properly be facilitated based on the centrifugal separation effect described above.

The present invention described above in terms of the embodiments includes the following forms.

(1) An integrated object acquired by integrating the head-side plunger constituent section 23 and the bottom-side plunger constituent section 22 is used as the plunger 14.

(2) The orientation direction of the oil supply hole 40 is directed outward in the radial direction as compared to the axis O of the plunger 14 and is directed in the direction orthogonal to the axis O of the plunger 14 (the left-right direction of FIG. 2).

(3) The inner diameter of the plunger 14 is made smaller on the bottom section 20 side as compared to the head section 19 side to increase the speed of the swirl flow S on the plunger bottom section 20 side.

(4) When the oil is discharged from the communication hole 25 of the plunger head section 19 to the outside, a gap formed between the rocker arm 4 (the inner surface of the concave section 26) and the plunger head section 19 is used. Accordingly, the communication passage 27 (see FIGS. 1 and 2) may not be disposed in the rocker arm 4.

EXPLANATIONS OF LETTERS OR NUMERALS

5 hydraulic lash adjuster
13 body
13*b* body bottom section
13*c* body circumferential wall section
14 plunger
19 plunger head section
20 plunger bottom section
21 plunger circumferential wall section
24 reservoir (low pressure chamber)
25 communication hole
28 high pressure chamber
40 oil supply hole
41 return spring (biasing means)
42 valve mechanism
O axis
S swirl flow

The invention claimed is:

1. A hydraulic lash adjuster comprising:

a hollow, cylindrical plunger slidably fitted into a bottomed cylindrical body, the plunger having a head section projecting from an opening side of the cylindrical body, a circumferential wall of the plunger surrounding a central axis and defining a low pressure chamber that stores oil, and a communication hole formed in the head section to allow communication between an inside and an outside of the low pressure chamber, a high pressure chamber defined between a bottom section of the cylindrical body and a bottom section of the plunger, a return spring interposed between the bottom section of the body and the bottom section of the plunger, a valve mechanism disposed on the bottom section of the plunger, the valve mechanism opening to allow oil to flow from the low pressure chamber into the high pressure chamber upon movement of the plunger along the central axis due to a restoring force of the return spring, an oil supply hole formed in the circumferential wall at a position below a midpoint of a longitudinal height of the low pressure chamber for supplying of pressurized oil into the low pressure chamber, wherein the low pressure chamber is free of internal guides or baffles, and a center line of the oil supply hole is oriented both tangentially with respect to an interior surface of the circumferential wall, and obliquely toward the head section, and wherein the orientation and position of the oil supply hole induces the pressurized oil to generate an upwardly directed helical swirl within the low pressure chamber such that air bubbles entrained in the oil in the low pressure chamber are coarsened as the air bubbles rise along the central axis and are expelled through the communication hole in the head section due to a centrifugal separation effect from the upwardly directed helical swirl.

2. The hydraulic lash adjuster according to claim 1, wherein an inner diameter of the plunger is reduced from a bottom section side of the plunger toward a head section side of the plunger.

3. The hydraulic lash adjuster according to claim 2, wherein the oil supply hole includes a plurality of oil supply holes disposed at different positions along a circumferential direction of the plunger, and wherein the plurality of oil supply holes are oriented in a same tangential and oblique direction so as to form the upwardly directed helical swirl.

4. The hydraulic lash adjuster according to claim 1, wherein the head section of the plunger is used as a section receiving a concave section of a rocker arm, wherein the communication hole is set to allow communication between an external surface of the head section of the plunger housed inside the concave section of the rocker arm and the low pressure chamber, and wherein the communication hole is an only oil discharge hole formed in a protruding portion of the plunger.

5. A method of using a hydraulic lash adjuster comprising a hollow, cylindrical plunger slidably fitted into a bottomed cylindrical body, the plunger having a head section projecting from an opening side of the cylindrical body, a circumferential wall of the plunger surrounding a central axis and defining a low pressure chamber that stores oil, and a communication hole formed in the head section to allow communication between an inside and an outside of the low pressure chamber, a high pressure chamber defined between a bottom section of the cylindrical body and a bottom section of the plunger, a return spring interposed between the bottom section of the body and the bottom section of the plunger, a valve mechanism disposed on the bottom section of the plunger, the valve mechanism opening to allow oil to flow from the low pressure chamber into the high pressure chamber upon movement of the plunger along the central axis due to a restoring force of the return spring, an oil supply hole formed in the circumferential wall at a position below a midpoint of a longitudinal height of the low pressure chamber for supplying pressurized oil into the low pressure chamber, wherein the low pressure chamber is free of internal guides or baffles, and a center line of the oil supply hole is oriented both tangentially with respect to an interior surface of the circumferential wall, and obliquely toward the head section, the method comprising:

inducing the pressurized oil through the oil supply hole to generate an upwardly directed helical swirl within the low pressure chamber such that air bubbles entrained in the oil in the low pressure chamber are coarsened as the air bubbles rise along the central axis and are expelled through the communication hole in the head section due to a centrifugal separation effect from the upwardly directed helical swirl.

* * * * *